US006311990B1

(12) United States Patent
Landry

(10) Patent No.: US 6,311,990 B1
(45) Date of Patent: Nov. 6, 2001

(54) ICE SKATEBOARD AND RUNNER THEREFOR

(76) Inventor: Sylvain Landry, 360, Principal Street C.P. 1387, Cap-aux-Meules, Iles-de-la-Madeleine, Quebec (CA), G0B 1B0

( * ) Notice: Subject to any disclaimer, the term of this patent is extended or adjusted under 35 U.S.C. 154(b) by 0 days.

(21) Appl. No.: 09/539,708

(22) Filed: Mar. 31, 2000

Related U.S. Application Data

(63) Continuation-in-part of application No. 09/357,676, filed on Jul. 20, 1999, now abandoned

(60) Provisional application No. 60/093,409, filed on Jul. 20, 1998.

(51) Int. Cl.[7] ..... A63C 17/18

(52) U.S. Cl. ..... 280/14.26; 280/7.14; 280/87.042

(58) Field of Search ..... 280/7.13, 7.14, 280/14.21, 14.25, 14.26, 28, 87.041, 87.042

(56) References Cited

U.S. PATENT DOCUMENTS

| | | | | |
|---|---|---|---|---|
| 1,663,060 | * | 3/1928 | Rainey | 280/7.14 |
| 1,706,048 | * | 3/1929 | Van De Mark | 280/87.041 |
| 4,043,565 | * | 8/1977 | Mogannam | 280/7.13 |
| 4,114,913 | | 9/1978 | Newell et al. | 280/12 |
| 4,116,455 | * | 9/1978 | Dotson et al. | 280/7.14 X |
| 4,165,091 | | 8/1979 | Chadwick | 280/12 H |
| 4,194,753 | | 3/1980 | Schrishuhn, Jr. | 280/13 |
| 4,225,145 | * | 9/1980 | Carr | 280/7.14 |
| 4,244,593 | * | 1/1981 | Malone | 280/7.14 |
| 4,337,957 | * | 7/1982 | Heine | 280/7.14 |
| 4,521,029 | | 6/1985 | Mayes | 280/7.14 |
| 4,896,893 | | 1/1990 | Shumays et al. | 280/14.2 |
| 5,161,810 | | 11/1992 | DeCesare | 280/14.2 |

* cited by examiner

*Primary Examiner*—Michael Mar

(57) ABSTRACT

In the present invention, there is provided an ice skateboard comprising a bottom surface and trucks and axles mounted to the bottom surface. A set of runners is pivotally mounted to the axles. Each of the runners has a solid body, a bearing assembly, a metal blade mounted to the solid body and a centre of gravity between the bearing assembly and the metal blade. The maximum radial dimension of the runner about the bearing assembly is shorter than the distance of the axle from the bottom surface of the skateboard such that each runner is free to rotate about one of the axles to recede against the board. In another aspect, the metal blade of each runner is mounted in a slot and a cushion strip is mounted between the metal blade and the bottom surface of the slot for absorbing a vertical movement of the blade. The movements of the metal blade on a rough ice surface is partly absorbed by the cushion strip and only partly transmitted to the solid body, to the trucks and to the bottom surface of the ice skateboard.

20 Claims, 3 Drawing Sheets

ICE SKATEBOARD AND RUNNER THEREFOR

This is a continuation-in-part of application Ser. No. 09/357,676, filed on Jul. 20, 1999, now abandonded, and claims benefit of Provisional Application Ser. No. 60/093,409 filed Jul. 20, 1998.

FIELD OF THE INVENTION

The present invention relates to ice skateboards and particularly it relates to skateboard runners having shock-absorbing and safety features incorporated therein.

BACKGROUND OF THE INVENTION

Ice skateboards are often used outdoors on natural ice of a frozen pond, lake or river, and on sidewalks and in parking lots following a winter storm of freezing rain for example. These icy surfaces are normally harder than the artificial ice of an arena. Natural ice is also known to have a pebbly surface comprising frozen lumps, cracks and hollows. The irregular surfaces and the hardness of natural ice cause vibration stresses and associated deterioration to the structure of an ice skateboard. These vibration stresses are also known to increase fatigue of the user of the skateboard.

Each truck of a conventional roller skateboard usually has a resilient shock-absorbing member at the center thereof for acting simultaneously on both wheels on that truck. Although this arrangement is practical for use of roller skateboards, there are numerous advantages of having each blade of a four-runner ice skateboard independently cushioned. Some of these advantages are better stability, maneuverability and a smoother ride.

Examples of skateboards of the prior art for use on hard snow and ice are disclosed in the following documents:

- U.S. Pat. No. 4,114,913 issued on Sep. 19, 1978 to W. K. Newell et al.;
- U.S. Pat. No. 4,165,091 issued on Aug. 21, 1979 to D. E. Chadwick;
- U.S. Pat. No. 4,194,753 issued on Mar. 25, 1980 to D. Schrishuhn, Jr.;
- U.S. Pat. No. 4,225,145 issued on Sep. 30, 1980 to R. K. Carr;
- U.S. Pat. No. 4,521,029 issued on Jun. 4, 1985 to T. L. Mayes;
- U.S. Pat. No. 4,896,893 issued on Jan. 30, 1990 to A. A. Shumays et al.;
- U.S. Pat. No. 5,161,810 issued on Nov. 10, 1992 to J. J. DeCesare.

Although these prior inventions deserve undeniable merits, there is no known prior art which provides for individual cushioning of the blades of an ice skateboard.

Therefore it is believed that there continues to be a need for a skateboard runner which has shock absorbing features incorporated therein, which is easily mountable to the truck axle of a roller skateboard and wherein the alignment of the blade relative the truck axle is maintainable at all times. Further, it is believed that there continues to be a need for a skateboard runner from which the blade is easily demountable for sharpening or for replacement.

SUMMARY OF THE INVENTION

The present invention provides for an ice skateboard and runners therefor in which the blades are individually cushioned, easily demountable and pivotal around each truck axle to recede toward the skateboard during a fall for example.

Broadly, in a first aspect of the present invention, there is provided an ice skateboard comprising a bottom surface and trucks and axles mounted to the bottom surface. The ice skateboard also comprises skateboard runners pivotally mounted to the axles. Each of the skateboard runners has a solid body comprising an upper and lower portions, a bearing assembly mounted therein at a central region thereof, a metal blade mounted to the lower portion, a centre of gravity between the bearing assembly and the metal blade, and a maximum radial dimension relative to the bearing assembly. The maximum radial dimension of the runner is shorter than the distance of the axle from the bottom surface of the skateboard.

The principal advantage of this first feature is safety. During the overturning of the skateboard, in a fall for example, each skateboard runner is free to rotate about one of the axles to recede against the board. Even if the user falls over the overturned skateboard, he/she has less chance of hurting himself/herself against the sharp edges of the blades.

In accordance with another aspect of the present invention, there is provided an ice skateboard wherein the solid body of each skateboard runner has a slot in the lower portion thereof. The slot has a bottom surface and two closed end walls. The metal blade is mounted in the slot and held longitudinally inside the two closed end walls. There is also provided a cushion strip mounted between the metal blade and the bottom surface of the slot for absorbing a vertical movement of the blade.

This particular feature is advantageous because the movements of the metal blade on a rough ice surface is partly absorbed by the cushion strip and only partly transmitted to the solid body, to the trucks and to the bottom surface of the ice skateboard. The ice skateboard of the present invention gives a smooth ride as compared with other ice skateboards having uncushioned runners.

In accordance with yet another aspect of the present invention, there is provided a skateboard runner for use on a roller skateboard in replacement of a wheel of the roller skateboard. The skateboard runner comprises a solid body having a length, an upper and lower portions, a bearing assembly mounted therein at a central region thereof relative to the length and a slot in the lower portion. There are also provided a metal blade mounted in the slot and a cushion strip mounted between the metal blade and the bottom surface of the slot. The bearing assembly in the solid body is similar to the bearing assembly found in common skateboard wheels, whereby the skateboard runner according to the present invention is readily mountable to the axle of a skateboard truck in a same manner as for a common skateboard wheel.

In accordance with a further aspect of the present invention, the metal blade in each skateboard runner further has keyholes therein, and is retained inside the slot in the solid body by bolts extending from the keyholes to the upper portion of the solid body. There are also provided a spring and washer assembly mounted on each of the bolts for adjusting a compression of the cushion strip between the bottom surface of the cavity and the metal blade, and for adjusting the degree of shock absorption of the cushion strip according to the preference of individual users.

Still another feature of the invention is that it is susceptible of a low cost of manufacture with regard to materials, equipment and labour, and which accordingly is then susceptible of low price of sale to the industry, thereby making such skateboard runners and ice skateboards economically available to the public.

Other advantages and novel features of the present invention will become apparent from the following detailed description.

BRIEF DESCRIPTION OF THE DRAWINGS

Two preferred embodiments of skateboard runners according to the present invention selected by way of examples will now be described with reference to the accompanying drawings in which.

Figure 1:
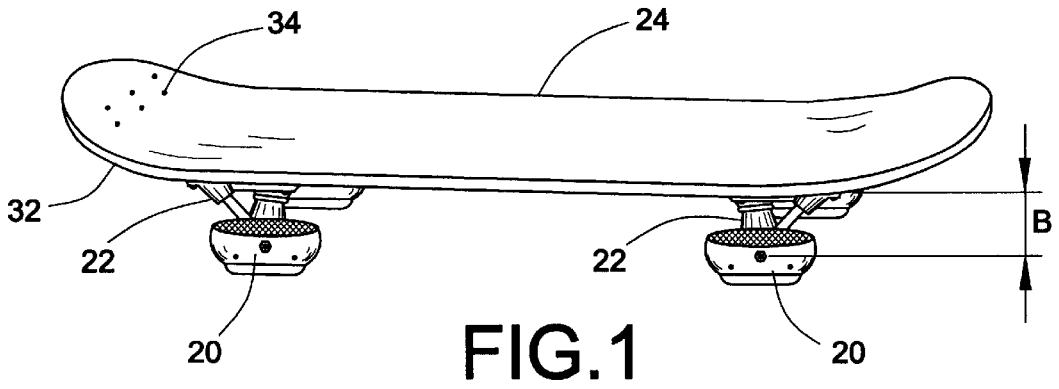
FIG. 1 illustrates an ice skateboard having the skateboard runners according to the first preferred embodiment of the present invention mounted thereon.
Figure 2:
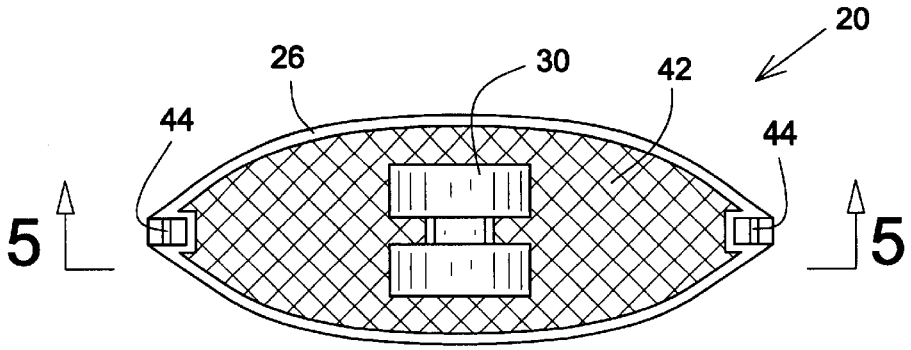
FIG. 2 illustrates a top view of the skateboard runner according to the first preferred embodiment of the present invention.
Figure 3:
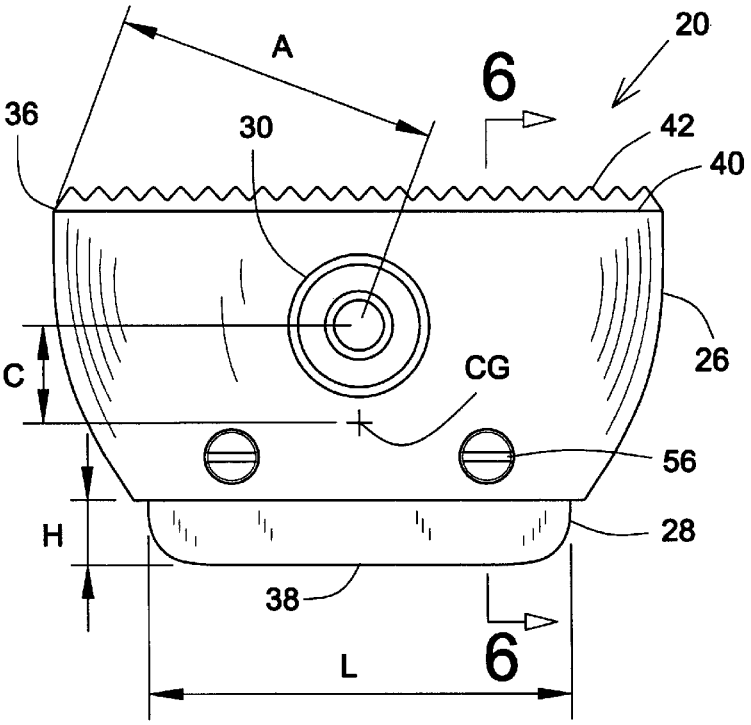
Figure 4:
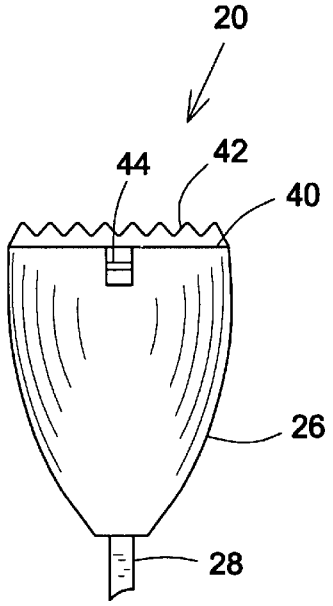
Figure 5:
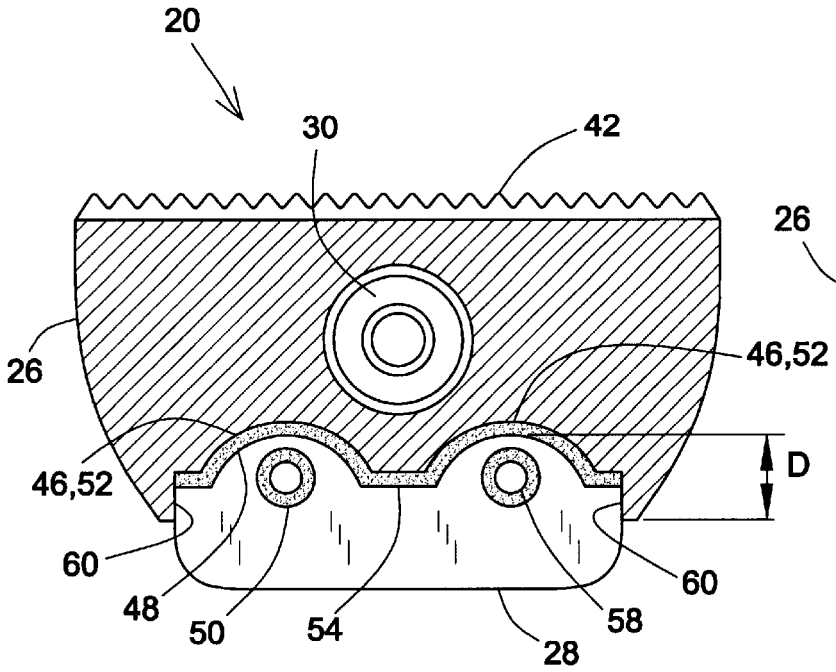
Figure 7:
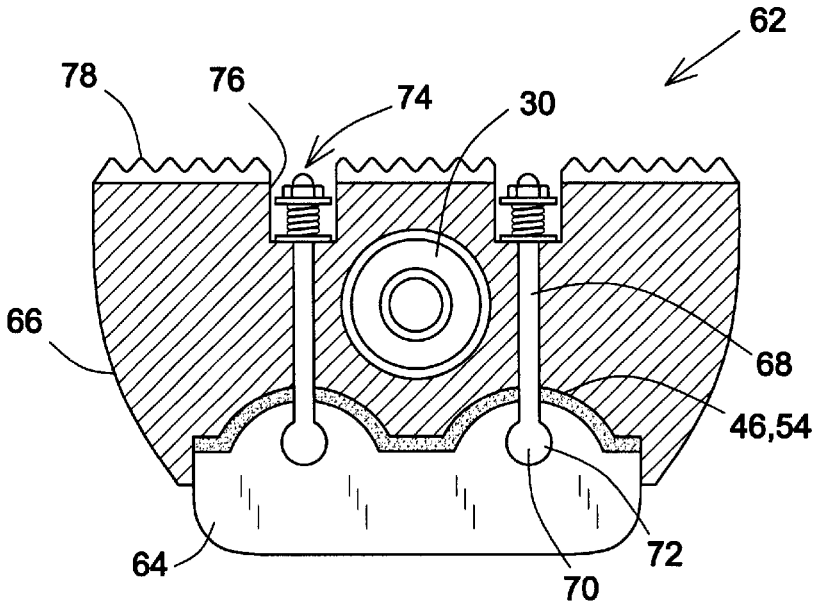
Figure 8:
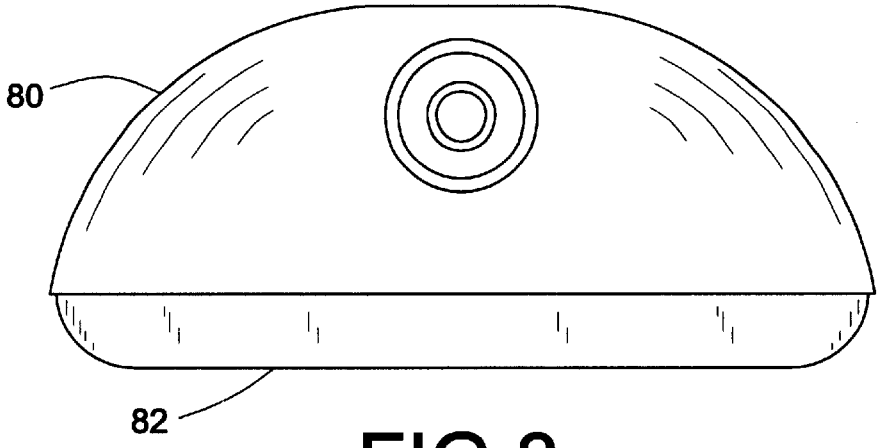
Figure 9:
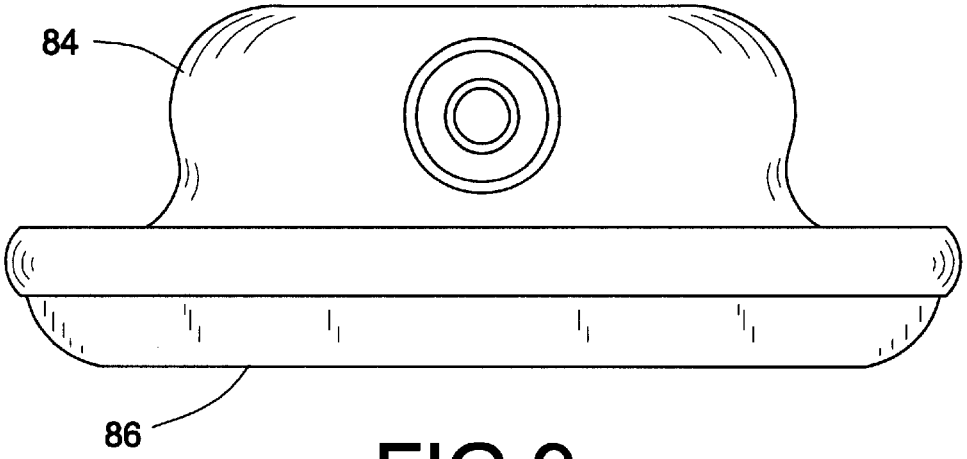
Figure 10:
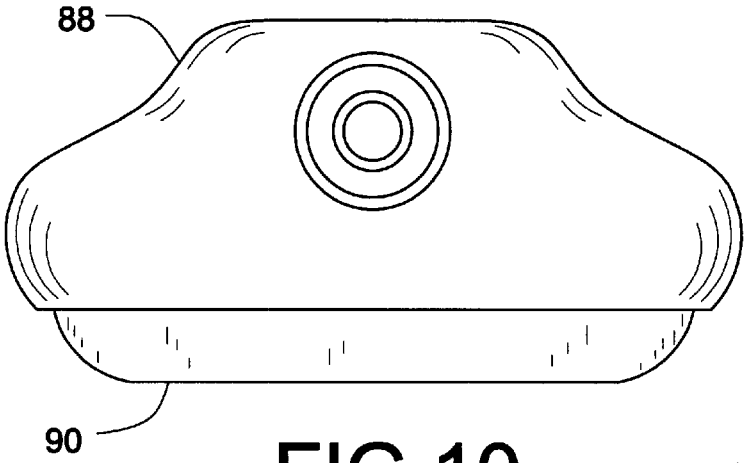

FIG. is 3 a side view of the skateboard runner according to the first preferred embodiment;

FIG. 4 is an end view of the skateboard runner according to the first preferred embodiment;

FIG. 5 is a cross-section view of the skateboard runner according to the first preferred embodiment along line 5—5 in FIG. 2;

FIG. is 6 a cross-section view of the skateboard runner according to the first preferred embodiment along line 6—6 in FIG. 3;

FIG. 7 is a cross-section view of the skateboard runner according to the second preferred embodiment along a similar location as for the view of FIG. 5; the only difference between the skateboard runners of the first and second preferred embodiments being found in the mounting arrangement for the metal blade of each runner;

FIG. 8. illustrates a side view of a first shape variant of the skateboard runner according to the second preferred embodiment;

FIG. 9 is a side view of a second shape variant of the skateboard runner according to the second preferred embodiment;

FIG. 10 is a side view of a third shape variant of the skateboard runner according to the second preferred embodiment.

DETAILED DESCRIPTION OF THE PREFERRED EMBODIMENTS

While this invention is susceptible of embodiments in many various forms, there is shown in the drawings and will be described in details herein a first and second preferred embodiments of skateboard runners according to the present invention, and shape variants of the second preferred embodiment, with the understanding that the present disclosure is to be considered as an example of the principles of the invention and is not intended to limit the invention to the embodiments illustrated.

Referring firstly to FIGS. 1–4, the skateboard runner 20 according to the first preferred embodiment is mountable to the truck 22 of a roller skateboard 24 in replacement of a wheel (not shown) of this skateboard. The skateboard runner 20 according to the first preferred embodiment comprises a solid body 26 made of hard plastic for example, and a metal blade 28 mounted to the lower portion of this solid body. The solid body 26 has rounded, aesthetically pleasing and aerodynamic shapes.

The skateboard runner 20 also comprises a bearing assembly 30 mounted inside the solid body and which is adapted for mounting on the axle of a skateboard truck 22 in a manner which is similar to the mounting of a common skateboard wheel (not shown). Further details of such mounting and of the bearing assembly are therefore unnecessary.

In the preferred installation, the skateboard 24 has four runners 20 pivotally mounted to the truck axles, and a fifth bearingless runner 32 mounted transversely to the rear end of the skateboard 24 for use as a brake on this skateboard. The bearingless runner 32 is partly illustrated in FIG. 1, and is practically identical to the skateboard runner 20 according to the first preferred embodiment except that it does not have a bearing assembly. This runner 32 is retained to the skateboard by screws 34, rivets or similar fasteners.

The metal blade 28 on the skateboard runner according to the first preferred embodiment has a relatively short length as compared with the shape variants illustrated in FIGS. 8–10. The proportions of runner 20 of the first preferred embodiment and the blade length illustrated are believed to be appropriate for use on various ice surfaces and in different skateboarding conditions.

The preferred length of the runner 20 according to the first preferred embodiment is such that a maximum radial dimension 'A' of the runner 20, measured from the center of the bearing assembly 30 to the front or rear tip 36 of the runner is shorter than a height 'B' between the truck axle and the bottom surface of the skateboard. This dimension 'A' is advantageous for allowing a full rotation of the runner 20 about the truck axle and the bearing assembly 30 when the runner is mounted to the skateboard 24.

Furthermore, the center of gravity 'CG' of the preferred skateboard runner 20 is on the blade side of the bearing assembly 30 as shown by distance 'C' in FIG. 3, such that the runner if able to swing freely to maintain the metal blade downward when the skateboard is raised or held above the ice.

The above features are particularly appreciable for increasing the safety of the skateboard during a fall of the user for example. During a fall of the user with a conventional skateboard, the skateboard is susceptible of turning over with the runners 20 exposed. With the ice skateboard of the present invention, the center of gravity 'CG' and the dimension 'A' of the runners 20 cause the runners 20 to rotate about the bearing assembly 30 to maintain the cutting edge 38 of the blade 28 pointing downward at all times.

In order to further increase to safety of the ice skateboard 24 having the runners 20 according to the first preferred embodiment, the solid body 26 of each runner 20 has an upper surface 40 covered with a layer 42 of soft padding material. Therefore, when a user unfortunately makes a fall and comes down on the skateboard in a turned-over position, that user has less chances of hurting himself/herself against the cutting edges 38 of the blades or against the runners 20, in comparison with other conventional skateboards of the prior art.

Other features of the preferred runner 20 comprise a blade length 'L' of about 2.5 inches (63 mm), and an exposed blade height 'H' of about ⅜ to 7⁄16 inch, (10 mm).

Referring back to FIG. 2, there are also provided, on the tips 36 of each runner 20, a hook member 44 which is partly illustrated therein. These hook members 44 are useful for anchoring an elastic cord (not shown) or other similar stabilizing means to prevent a free rotation of each runner 20 about its bearing assembly 30, when such a movement restriction is desired.

Figure 6:
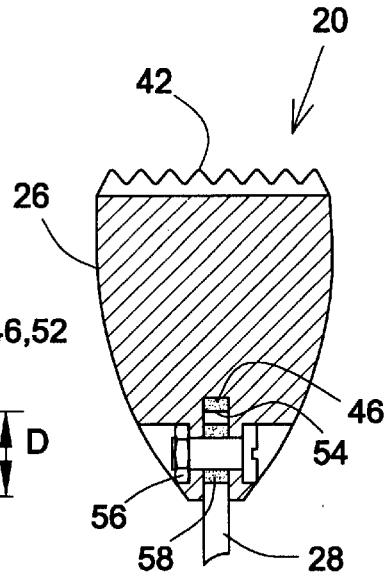

Referring now to FIGS. 5 and 6, there is illustrated therein another important feature of the skateboard runner 20 according to the first preferred embodiment. The lower part of the solid body 26 has a slot 46 formed therein for receiving and for partly enclosing the metal blade 28. The metal blade 28 preferably has two humps 48 along its upper edge and a mounting hole 50 in each hump. The slot 46 has a pair of rounded cavities 52 therein each having a shape for receiving one of the humps 48. There is also provided a contoured strip 54 made of resilient material, disposed in the bottom of the slot 46 between the humps 48 and the rounded cavities 52 for cushioning a vertical movement of the blade 28 inside the slot 46.

Each blade 28 is held to the solid body 26 by two screws 56 extending transversally through the solid body 26 and through the hole 50 in the blade. A pair of discs 58 also made of resilient material are respectively mounted inside each hole 50 and around each screw 56. The contoured resilient strip 54 and the disc 58 are made of rubber or resilient material of the like and contribute to absorbing the shocks on the blade 28 when the skateboard runner 20 is used on rough ice surfaces. The impacts on the blade 28 are thereby only partly transmitted to the solid body 26, to the bearing assembly 30 and to the axle of the truck 22. The ice skateboard 24 having skateboard runners 20 according to the first preferred embodiment is thereby smoother and easier to maneuver than other conventional skateboards.

While the movement of the blade 28 is cushioned in a vertical direction, the blade is held fixed longitudinally relative to the solid body 26 inside two closed walls 60, one at each extremity of the slot 46. The width of the slot 46 is a precise sliding fit dimension relative to the thickness of the blade 28. Therefore, the blade is also held fixed transversally relative to the solid body 26. For reference purposes, the blade 28 extends inside the slot 46 a distance 'D' of about ½ inch (12 mm). The alignment of the blade 28 and its longitudinal position are thereby maintained fixed relative to the bearing assembly 30. This mounting ensures that the cushioning of the blades 28 in a vertical direction does not cause any negative effects on the maneuverability of the skateboard or on its forward speed. Referring now to FIG. 7 there is illustrated therein an essential feature of skateboard runner 62 according to the second preferred embodiment. The skateboard runner 62 according to the second preferred embodiment has several features in common with the skateboard runner 20 according to the first preferred embodiment, and has all the advantages associated with the common features.

In the second preferred skateboard runner 62, the blade 64 is held to the solid body 66 by means of a pair of elongated plug-ended bolts 68. A disc-like plug 70 on the extremity of each bolt 68 is engaged in a keyhole slot 72 in the upper segment of the blade 64. A spring and nut assembly 74 is mounted on the end of each bolt 68 and is encased inside a socket 76 extending down through the top surface 78 of the solid body 66. The skateboard runner 62 according to the second preferred embodiment also has a slot 46 and a resilient strip 54 mounted inside the slot between the bottom surface of the slot and the upper edge of the blade 64. This arrangement is particularly advantageous for compressing more or less the resilient strip 54 and for adjusting the shock absorbing characteristics of that resilient strip 54.

While the two blade mounting arrangements illustrated are different from each other, both systems permit easy removal of the blade from the solid body for replacement of the blade for example.

Referring to FIGS. 8–10, there are illustrated therein three shape variants of the skateboard runner 62 according to the second preferred embodiment. While these shape variants may not share the safety feature associated with the dimensions of the runner according to the first and second preferred embodiments, it is believed that the longer blades illustrated have their advantages in competition racing. The runner 80 according to a first shape variant has a blade 82 of a medium length for use in skateboarding competitions on relatively smooth ice surfaces and straight courses. The runner 84 according to the second shape variant has a long blade 86 for use in high speed skateboarding competitions. The runner 88 according to the third shape variant has a blade 90 of a relatively short length for use in skateboarding competitions on smooth ice surfaces and devious courses. The blades in the three shape variants are preferably mounted to the respective solid body by plug-ended bolts such as those illustrated for the blade 64 of the runner according to the second preferred embodiment.

As to additional details related to the manufacturing, installation and use of the skateboard runners of the present invention, the same should be apparent from the above description, and accordingly further discussion relative to the manner of making, installing and using these runners would be considered redundant and is not provided.

While two embodiments of the present invention have been described herein above, it will be appreciated by those skilled in the art that various modifications, alternate constructions, mounting arrangements and equivalents may be employed without departing from the true spirit and scope of the invention. Therefore, the above description and illustrations should not be construed as limiting the scope of the invention which is defined by the appended claims.

I claim:

1. An ice skateboard comprising:

an elongated board having a top surface and a bottom surface; a plurality of truck assemblies mounted to said bottom surface, each truck assembly having an axle; and a plurality of runner assemblies mounted to said axles, each runner assembly including a solid body having an upper portion and a lower portion, said upper portion having a substantially planar top surface with a layer of padding attached thereto, a bearing assembly mounted within said solid body at a central region relative to a longitudinal length thereof, said bearing assembly being rotatably mounted on an end of a respective one of said axles for providing free rotation of said runner assembly about a transverse rotational axis extending through said axle, a slot in said lower portion and formed with a bottom opening and an innermost surface opposite said bottom opening, and a metal blade mounted within said slot, wherein the transverse rotational axis of said runner assembly is located between said top surface and a transverse rotational center of gravity of said runner assembly for maintaining said top and bottom portions of the runner assembly in their respective orientation when the ice skateboard is in either a normal position with the bottom surface facing downwardly or when the ice skateboard is in an inverted position with the bottom surface facing upwardly.

2. The ice skateboard as claimed in claim 1, wherein said top surface of each of said runner assemblies includes hook members located at longitudinal extremities thereof for having an elastic cord stabilizer of said ice skateboard secured thereto, thereby limiting said free rotation of said runner assembly around said axle.

3. The ice skateboard as claimed in claim 1, where in said metal blade of said skateboard runner has a length of about 2-⅕ inches.

4. The ice skateboard as claimed in claim 1, wherein each of said runner assemblies has a cushion strip mounted within said slot between said metal blade and said innermost surface of said slot for absorbing vibrations transmitted therebetween.

5. The ice skateboard as claimed in claim 1, wherein said metal blade of each of said runner assemblies has two humps thereon, said slot has two rounded cavities therein around said humps, and said cushion strip is a contoured strip disposed between said humps and said rounded cavities.

6. The ice skateboard as claimed in claim 1, wherein said metal blade of each of said runner assemblies further has a hole in each of said humps, said metal blade being retained to said solid body by bolts respectively extending through one of said holes, and each of said runner assemblies further comprises a cushion washer disposed inside each of said holes and around each of said bolts.

7. The ice skateboard as claimed in claim 4, wherein said slot in said solid body of each of said runner assemblies has two closed end walls tightly enclosing said metal blade therebetween in a longitudinal direction of said runner assembly.

8. The ice skateboard as claimed in claim 7, wherein said slot in said solid body of each of said runner assemblies has a width being a precise sliding fit over a thickness of said metal blade.

9. The ice skateboard as claimed in claim 1, wherein said metal blade of each of said runner assemblies further has a keyhole in each of said humps, said metal blade being retained to said solid body by bolts respectively extending from one of said keyholes, through said solid body, to said upper portion of said solid body.

10. The ice skateboard as claimed in claim 9, wherein each of said runner assemblies further comprises a spring and washer assembly mounted on each of said bolts for adjusting a compression of said cushion strip between said innermost surface of said slot and said metal blade.

11. An ice skateboard comprising:

an elongated board having a top surface and a bottom surface; a plurality of truck assemblies mounted to said bottom surface, each truck assembly having an axle; and a plurality of runner assemblies mounted to said axles, each runner assembly including a solid body having an upper portion and a lower portion, a longitudinal length of said upper portion being greater than a longitudinal length of said lower portion, a bearing assembly mounted within said solid body at a central region relative to said longitudinal length, said bearing assembly being rotatably mounted on an end of a respective one of said axles for providing free rotation of said runner assembly about a transverse rotational axis extending through said axle, a slot in said lower portion and formed with a bottom opening and an innermost surface opposite said bottom opening, a metal blade mounted within said slot, and a cushion strip mounted within said slot between said metal blade and said innermost surface of said slot for absorbing vibrations transmitted therebetween, wherein the transverse rotational axis of said runner assembly is located between a top surface of said upper portion and a transverse rotational center of gravity of said runner assembly for maintaining said top and bottom portions of the runner assembly in their respective orientation when the ice skateboard is in either a normal position with the bottom surface facing downwardly or when the ice skateboard is in an inverted position with the bottom surface facing upwardly.

12. The ice skateboard as claimed in claim 11, wherein said slot in said solid body of each of said runner assemblies has two closed end walls tightly enclosing said metal blade in a longitudinal direction of said runner assembly, and a width being a precise sliding fit over a thickness of said metal blade.

13. The ice skateboard as claimed in claim 12, wherein said metal blade of each of said runner assemblies further has a keyhole therein, said metal blade being retained to said solid body by a bolt extending from said keyhole to said upper portion of said solid body.

14. The ice skateboard as claimed in claim 13, wherein each of said runner assemblies further comprises a spring and washer assembly mounted on said bolt for adjusting a compression of said cushion strip between said innermost surface of said slot and said metal blade.

15. The ice skateboard as claimed in claim 11, wherein said top surface of said upper portion of each of said runner assemblies has a layer of padding attached thereto.

16. A skateboard runner assembly for use with an ice skateboard having an elongated board with a top surface and a bottom surface, and a plurality of truck assemblies mounted to said bottom surface with each truck assembly having an axle, said runner assembly comprising:

a solid body having an upper portion and a lower portion, said upper portion having a substantially planar top surface with a layer of padding attached thereto, a bearing assembly mounted within said solid body at a central region relative to a longitudinal length thereof, said bearing assembly being rotatably mounted on an end of a respective one of said axles for providing free rotation of said runner assembly about a transverse rotational axis extending through said axle, a slot in said lower portion and formed with a bottom opening and an innermost surface opposite said bottom opening, and a metal blade mounted within said slot, wherein the transverse rotational axis of said runner assembly is located between said top surface and a transverse rotational center of gravity of said runner assembly for maintaining said top and bottom portions of the runner assembly in their respective orientation when the ice skateboard is in either a normal position with the bottom surface facing downwardly or when the ice skateboard is in an inverted position with the bottom surface facing upwardly.

17. The runner assembly as claimed in claim 16, wherein said metal blade is secured to said solid body by means of a plurality of screws transversally extending through said metal blade and said solid body.

18. The runner assembly as claimed in claim 17, wherein said plurality of screws respectively extend through a plurality of holes located in said metal blade, said runner assembly further comprising a plurality of cushion washers mounted inside a respective one of said plurality of holes and over one of said plurality of screws.

19. The runner assembly as claimed in claim 18, wherein said metal blade comprises a pair of humps and said plurality of holes are located through said humps.

20. The runner assembly as claimed in claim 19, wherein said slot has end walls enclosing a length of said metal blade, and a width of said slot is a precise sliding fit over a thickness of said metal blade.

* * * * *